US011191990B2

(12) United States Patent
Wang

(10) Patent No.: US 11,191,990 B2
(45) Date of Patent: Dec. 7, 2021

(54) PORTABLE EXERCISE DEVICE

(71) Applicant: C2P (TAIWAN) LTD., Taichung (TW)

(72) Inventor: Chin-Liu Wang, Taichung (TW)

(73) Assignee: C2P (Taiwan) Ltd., Taichung (TW)

( * ) Notice: Subject to any disclaimer, the term of this patent is extended or adjusted under 35 U.S.C. 154(b) by 91 days.

(21) Appl. No.: 16/854,484

(22) Filed: Apr. 21, 2020

(65) Prior Publication Data

US 2021/0220690 A1 Jul. 22, 2021

(30) Foreign Application Priority Data

Jan. 21, 2020 (TW) ..... 1092008972

(51) Int. Cl.
*A63B 21/008* (2006.01)
*A63B 21/00* (2006.01)

(52) U.S. Cl.
CPC ..... *A63B 21/0088* (2013.01); *A63B 21/154* (2013.01)

(58) Field of Classification Search
CPC ..... A63B 21/0088; A63B 21/54; A63B 21/154–155; A63B 21/157; A63B 2022/0041; A63B 21/156; A63B 2022/0079; A63B 2024/0078; A63B 2071/065; A63B 2208/0228; A63B 2210/50; A63B 2230/75; A63B 21/00065; A63B 21/0052; A63B 21/0053; A63B 21/0057; A63B 21/153; A63B 21/169; A63B 21/4035; A63B 21/4043; A63B 22/0076; A63B 23/03541; A63B 23/1209; A63B 71/0686; A63B 21/15; A63B 21/152
See application file for complete search history.

(56) References Cited

U.S. PATENT DOCUMENTS

2012/0277068 A1* 11/2012 Zhou ..... A63B 23/03541 482/71
2015/0182773 A1* 7/2015 Olson ..... A63B 24/0087 482/8
2017/0319941 A1* 11/2017 Smith ..... A63B 21/153
2019/0099652 A1* 4/2019 Orady ..... A63B 23/12
2019/0217149 A1* 7/2019 Wang ..... A63B 21/00

* cited by examiner

*Primary Examiner* — Jennifer Robertson
*Assistant Examiner* — Catrina A Letterman
(74) *Attorney, Agent, or Firm* — Wang Law Firm, Inc.

(57) ABSTRACT

A portable exercise device provided includes: a base disc, two pulley assemblies, a support plate, and a fan wheel assembly. A support plate is disposed on the base disc, the two pulley assemblies are provided on the base disc, and the fan wheel assembly is provided on the support plate, so that the fan wheel assembly and the two pulley assemblies are vertically arranged on top of each other, thereby reducing the overall volume. More preferably, because the volume is reduced, the user can arbitrarily move and hang the portable exercise device at the desired position, and because the portable exercise device of the invention can be hung at different positions, which allows the user to train different muscles according to the different positions.

19 Claims, 10 Drawing Sheets

PORTABLE EXERCISE DEVICE

BACKGROUND

Field of the Invention

The present invention relates to the technical field of fitness, in particular to a portable exercise device.

Related Prior Art

Nowadays, people pay more and more attention to the body shape. Therefore, many people will go to the gym for aerobic exercise or weight lift during leisure time such as after work, after school, and holidays. There are many different types of exercise devices in the gym. The exercise devices essentially consists of pulleys, pull rods, rocker, etc which are assembled together to form different types of exercise devices, allowing users to select the appropriate exercise device for the muscle group they want to train.

Taking the rowing machine as an example, a user can usually sit on the seat of the rowing machine, and pull the handle of the rowing machine to train the user's muscles. However, the rowing machines is so large that ordinary families has no room for it. It is also difficult to carry them because of their large size. Therefore, most people can only use rowing machines in gyms.

Furthermore, the pulleys, pull rods, rockers of each exercise device are fixed. Therefore, when users want to train different muscle groups, they must use the corresponding device. Taking the rowing machine as an example, the rowing machine is mainly used to train the back, thighs, calves, glutes, and biceps. When training triceps, superior spines, infraspinalis, subscapularis, and other small muscle groups, the rowing machine can no longer be used, and other exercise device must be used instead. However, the exercise device is expensive, and average users can't afford to buy many different exercise devices at the same time. Therefore, the average users choose to share exercise devices in the gym.

The present invention has arisen to mitigate and/or obviate the afore-described disadvantages.

SUMMARY

One objective of the present invention is to solve the problem the exercise device.

Another objective of the present invention is to solve the problem that the exercise device can only train a single muscle group.

To achieve the above objectives, a portable exercise device provided by the invention comprises:

a base disc;

two pulley assemblies disposed on the base disc, and each including: a rope wheel, a belt wheel, and a wheel shaft, wherein the rope wheel is disposed on the wheel shaft through a one-way bearing, and the belt wheel is fixed on the wheel shaft;

a support plate has a support frame provided on the base disc, and a mounting seat provided on the support frame;

a fan wheel assembly disposed on the mounting seat and including: a fan wheel shaft inserted through the mounting seat and fixed on the base disc, and a fan wheel fixed to the fan wheel shaft;

a belt drivingly connected to the wheel shafts of the two pulley assemblies and the fan wheel shaft of the fan wheel assembly.

Preferably, a magnet adjustment assembly is provided on the base disc and includes two magnet seat rods, a magnet seat slidably provided on the magnet seat rods, and an adjusting rod for controlling displacement of the magnet seat, the magnet seat is provided with a plurality of NdFeB magnets and an inclined slot, and the adjusting rod is pivoted on the mounting seat and inserted through the inclined slot.

Preferably, each of the handles includes a handle portion and a fixing member, the handle portion is cylindrical-shaped for users to grip, two ends of the fixing member are respectively connected to the two ends of the handle portion to make the handle ring-shaped as a whole, and the fixing member is provided with two fixing recesses which are recessed in two different directions perpendicular to each other.

Preferably, there are two said support frames, the support frames are U-shaped and respectively mounted on the base disc, the mounting seat is fixed on the two support frames, and the two pulley assemblies are located between the mounting seat and the base disc.

Preferably, two pulley seats are disposed on the base disc and each includes a rod, a rope, and a handle, wherein the rods are fixed to the base disc, the ropes each have one end fixed to a corresponding one of the rope wheels and another end connected to a corresponding one of the handles, a pull rope spring box is mounted on the wheel shaft by a one-way bearing and is provided with a spiral spring.

Preferably, a mesh frame includes two mesh covers and an annular fixing strip, and the two mesh covers are fixed by the annular fixing strip to define an assembling space, and the base disc is fixed to one of the mesh covers and located in the assembling space.

Preferably, a generator is provided on the base disc and fixed on one of the support frames, the generator is provided with an electromagnet, the fan wheel is made of aluminum, and the generator is induced with the fan wheel to generate induced current.

Preferably, the fan wheel assembly further has a plurality of fan blades fixed to the fan wheel.

Preferably, a magnet ring is provided on the fan wheel.

Preferably, the base disc is provided with a wall-hanging assembly, and the wall-hanging assembly includes two fixing pieces inserted through one of the mesh covers, and each have a first hook and a second hook.

By providing a support plate on the base disc, the two pulley assemblies are provided on the base disc, and the fan wheel assembly is provided on the support plate, so that the fan wheel assembly and the two pulley assemblies are vertically arranged on top of each other, thereby reducing the overall volume. More preferably, because the volume is reduced, the user can arbitrarily move and hang the portable exercise device at the desired position, and because the portable exercise device of the invention can be hung at different positions, which allows the user to train different muscles according to the different positions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION

The present invention will be clearer from the following description when viewed together with the accompanying drawings, which show, for purpose of illustrations only, the preferred embodiment in accordance with the present invention.

Figure 1:
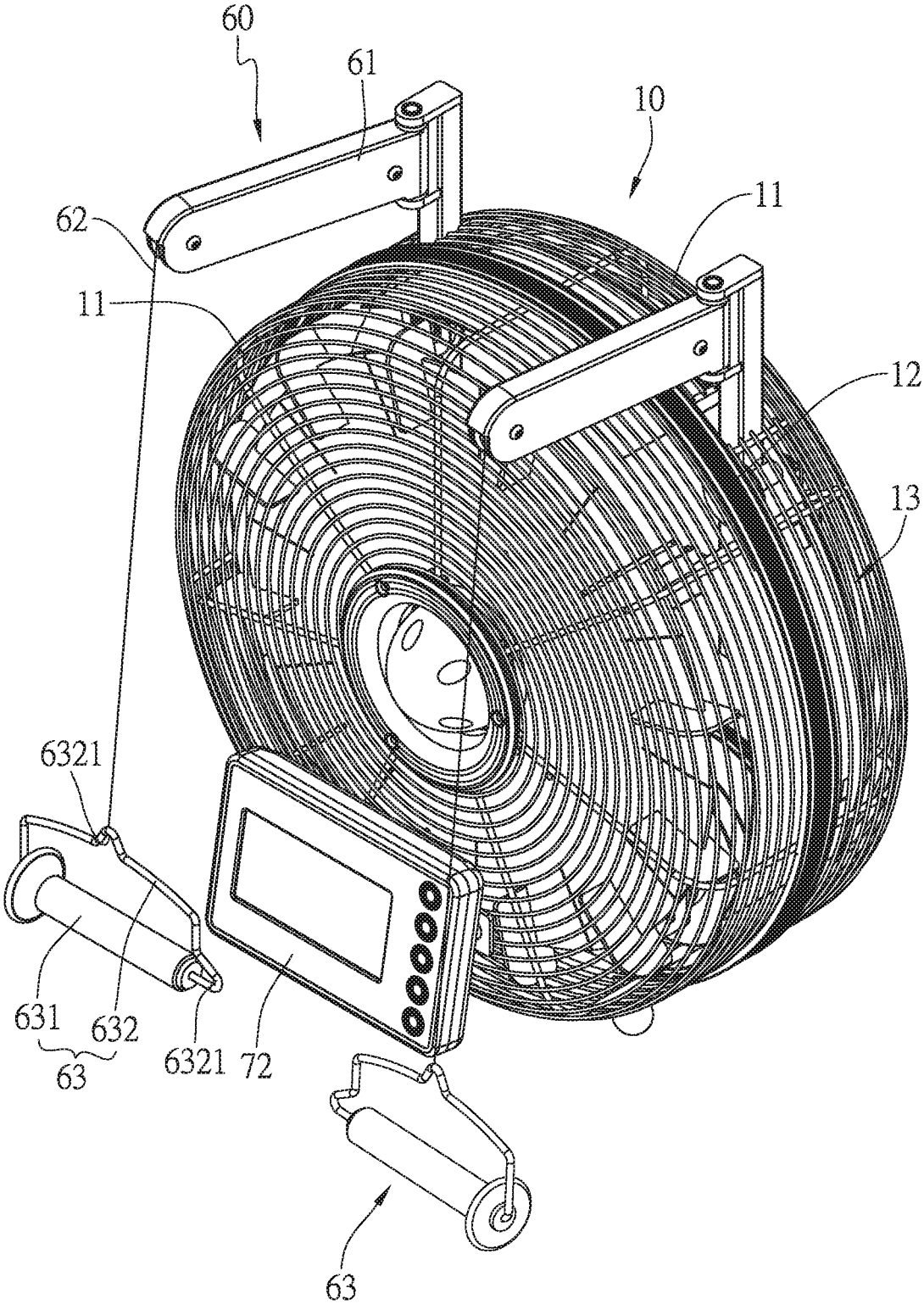
FIG. 1 is a perspective view of the novel model in a preferred embodiment.
Figure 2:
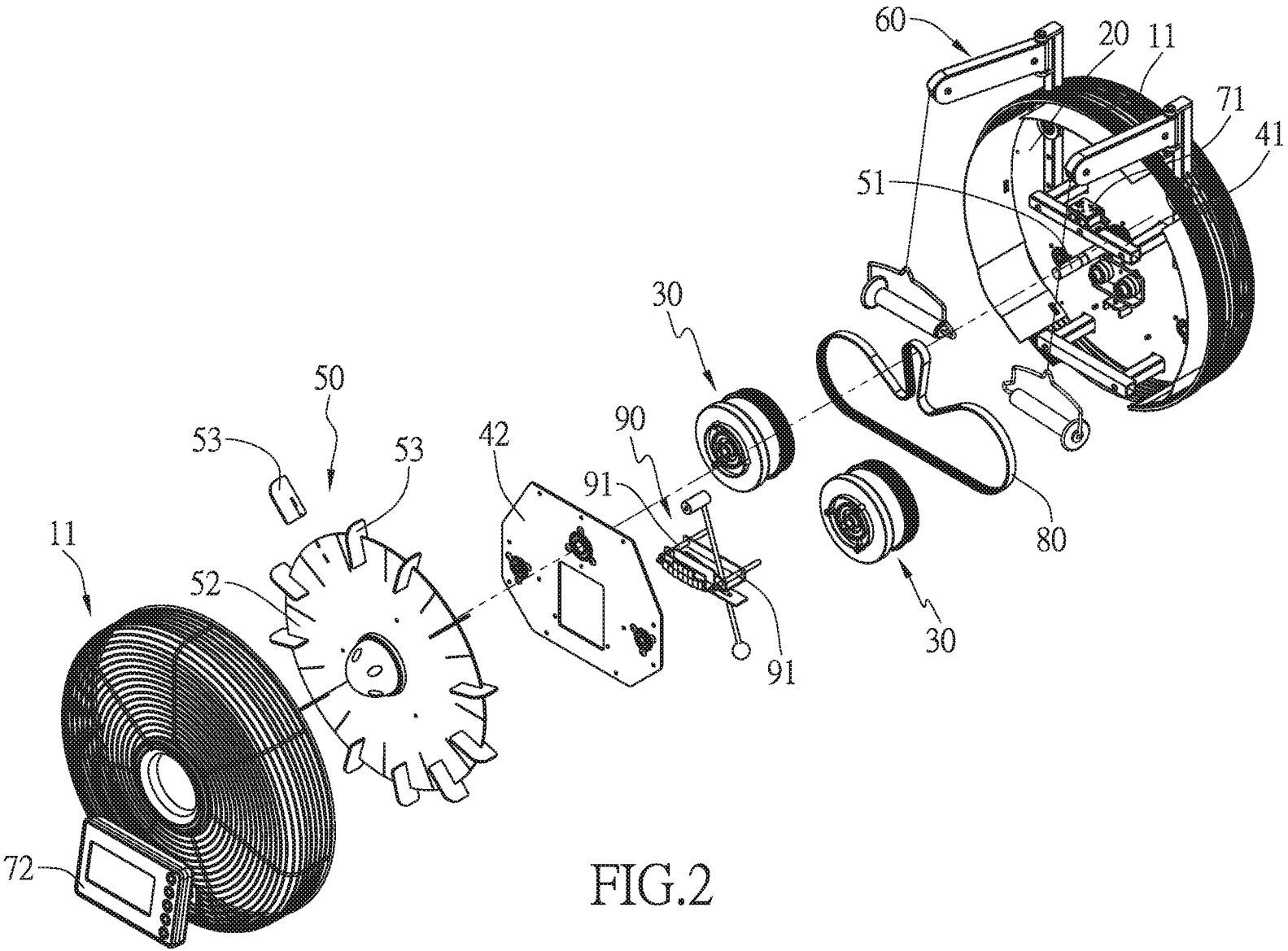
FIG. 2 is an exploded view of a preferred embodiment of the present invention.
Figure 3:
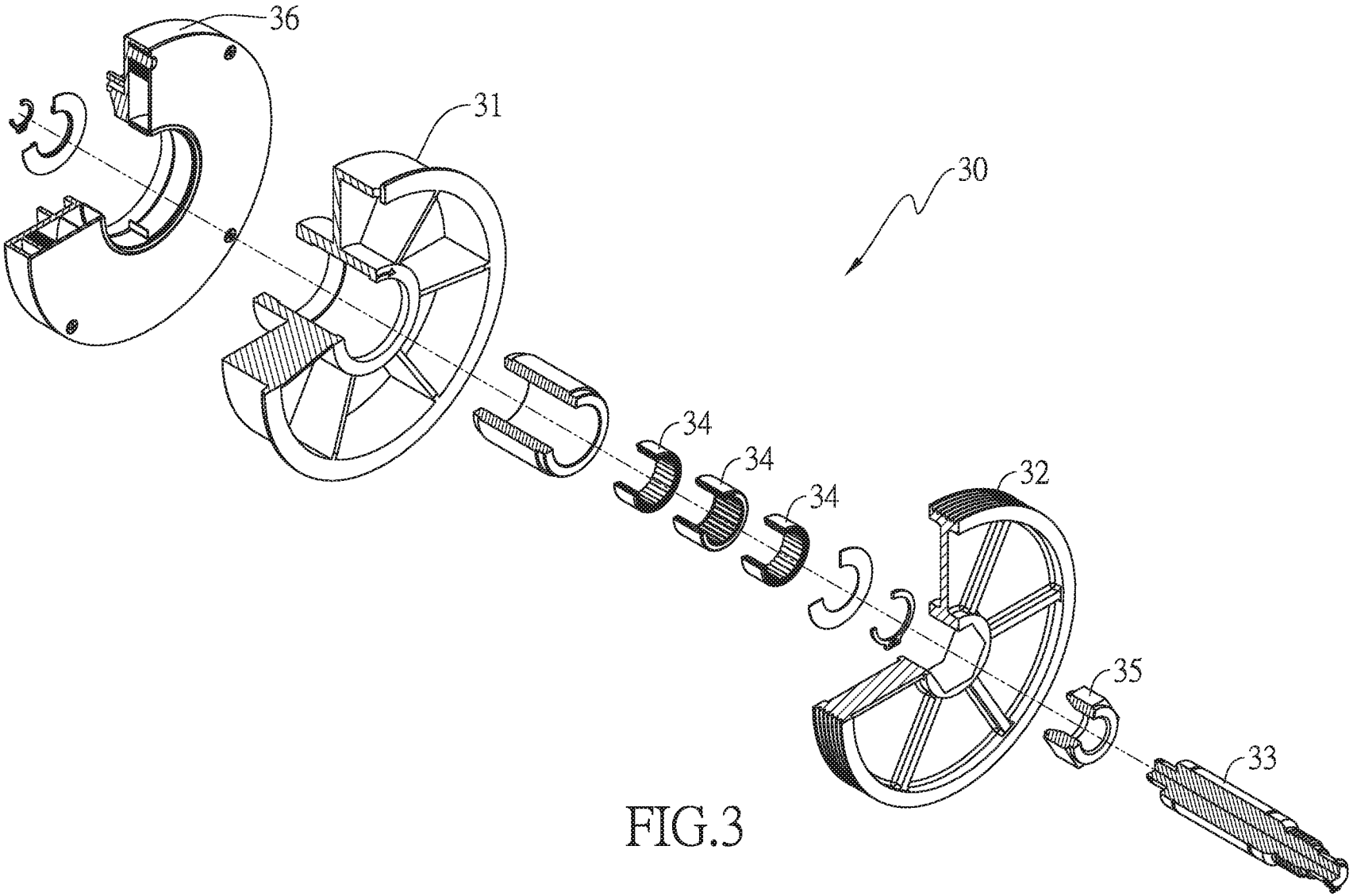
FIG. 3 is an exploded view of a pulley assembly.
Figure 4:
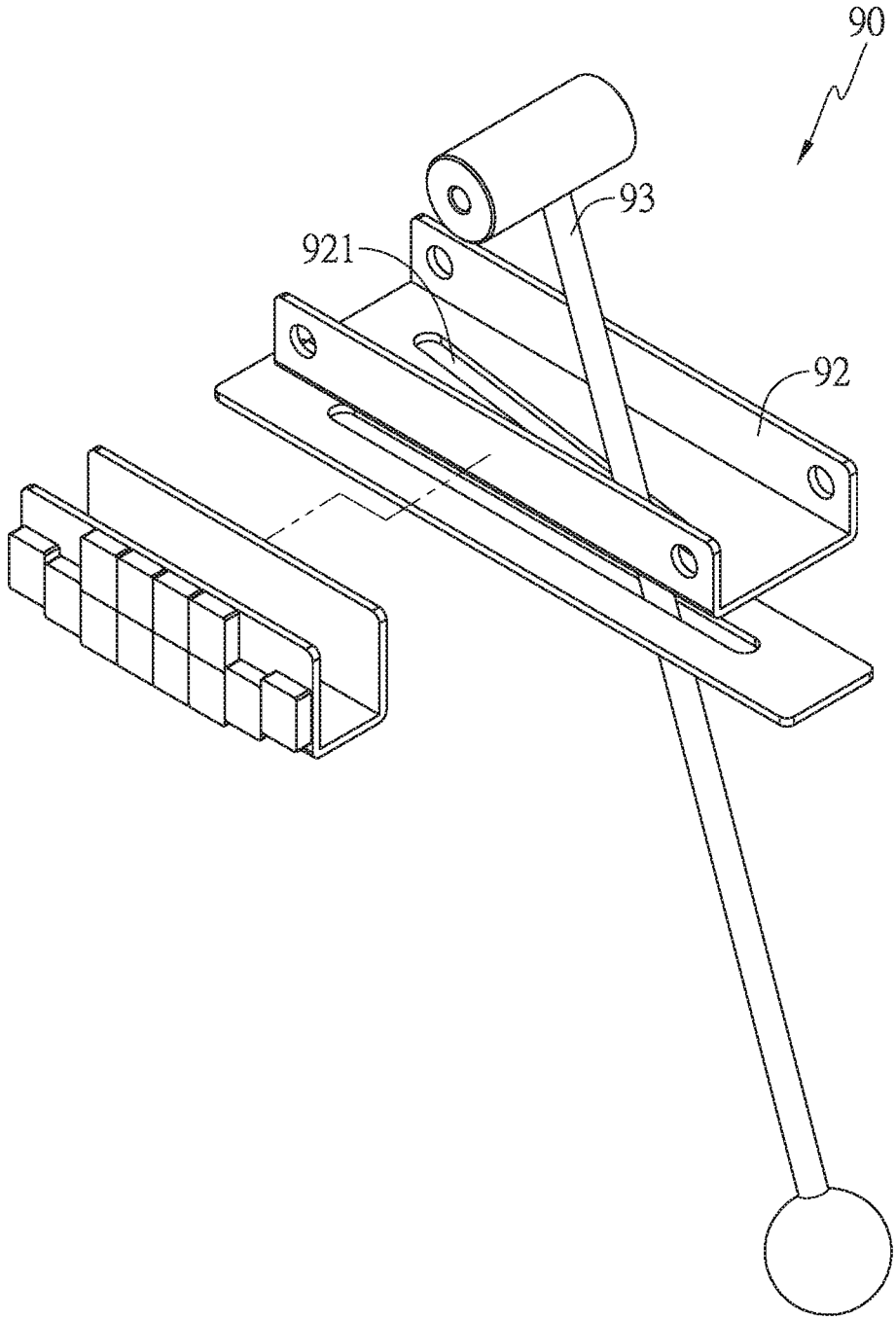
FIG. 4 is an exploded view of the magnet adjustment assembly.
Figure 5:
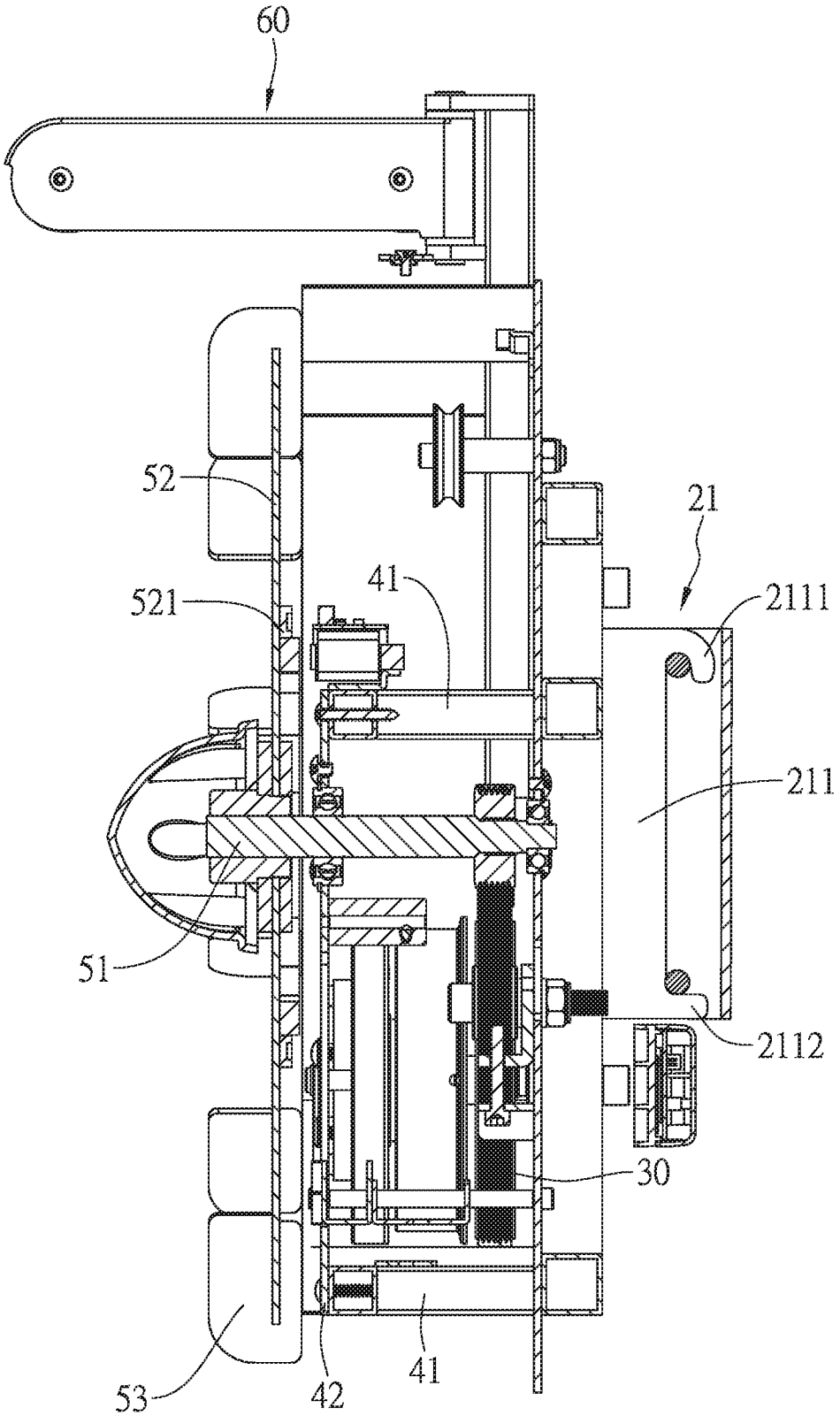
FIG. 5 is a sectional view of the present invention in a preferred embodiment.
Figure 6:
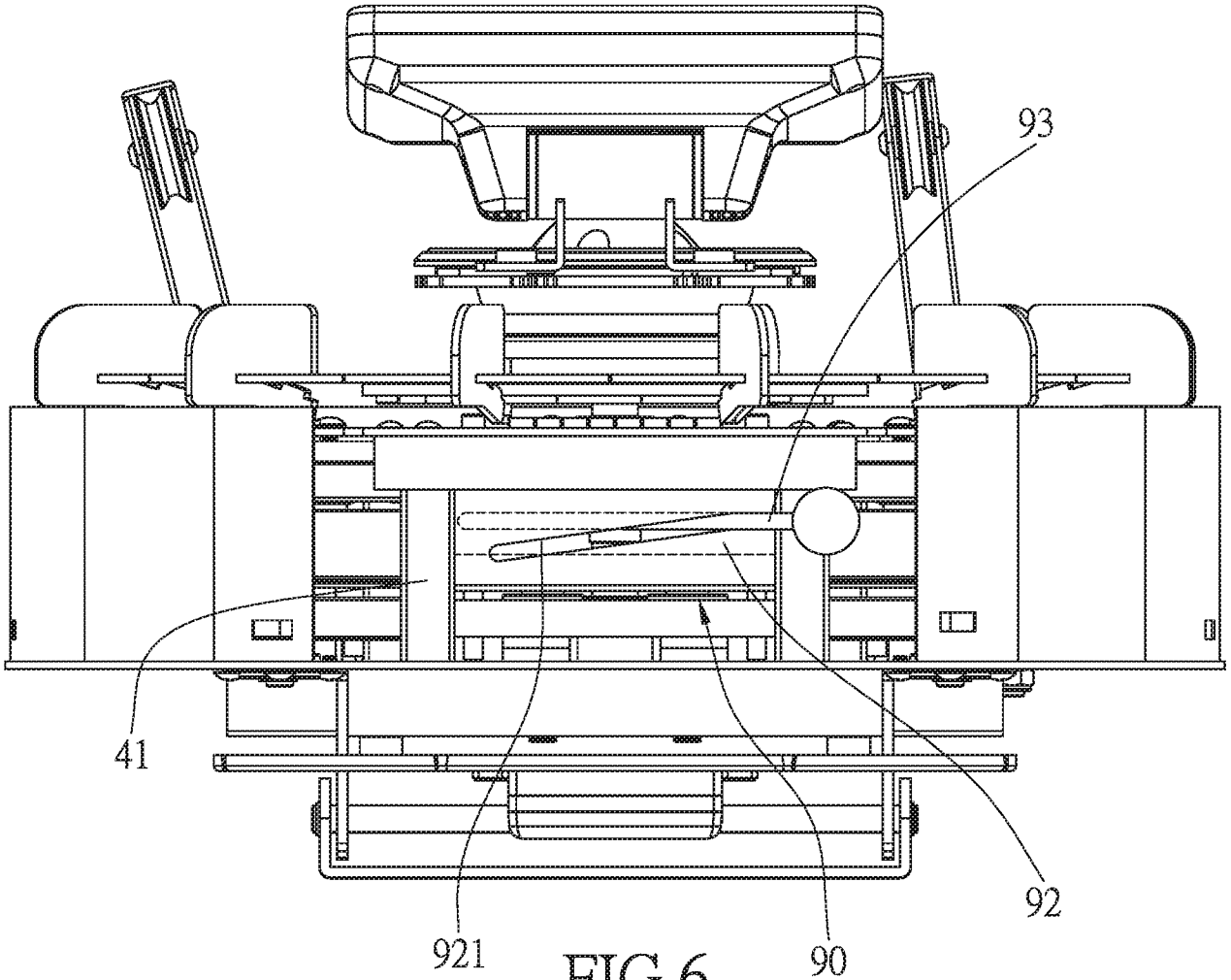
FIG. 6 is a schematic diagram of a preferred embodiment of the present invention, showing a state in which the resistance of the magnet adjustment assembly is adjusted to the maximum value.
Figure 7:
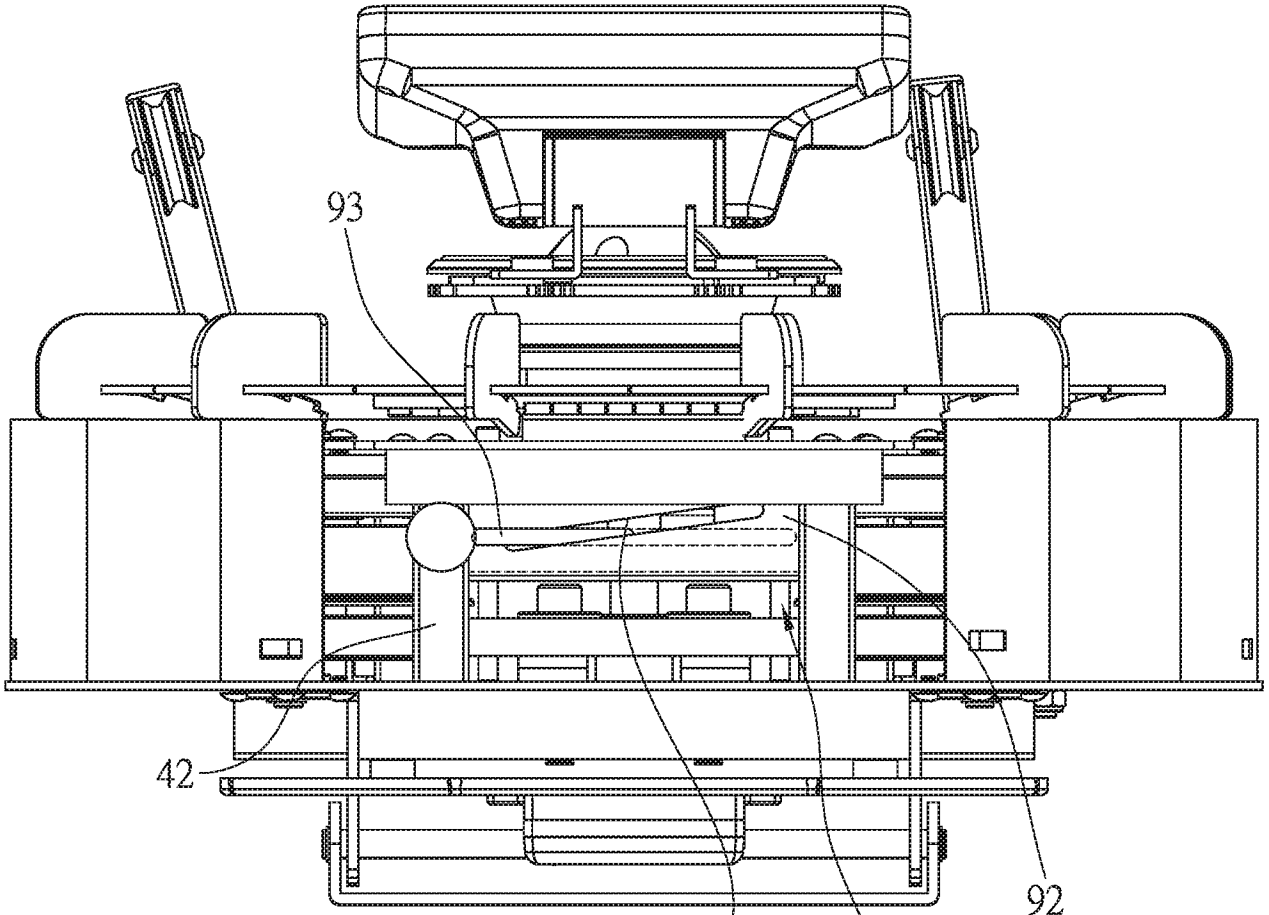
FIG. 7 is a schematic diagram of a preferred embodiment of the present invention, showing a state in which the resistance of the magnet adjustment assembly is adjusted to the minimum value.
Figure 8:
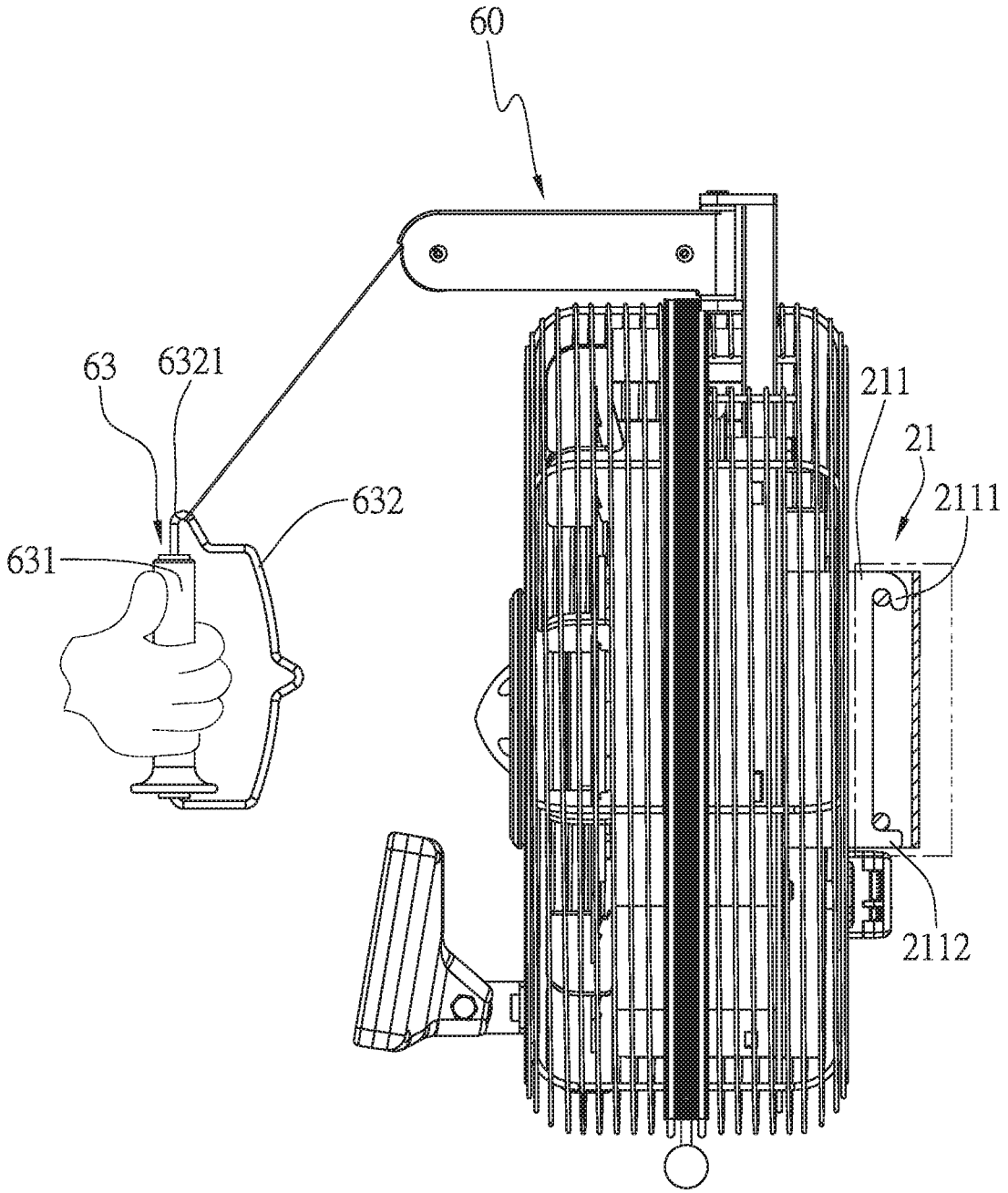
FIG. 8 is a schematic diagram of a preferred embodiment of the present invention, showing the portable exercise device hanging at a high place.
Figure 9:
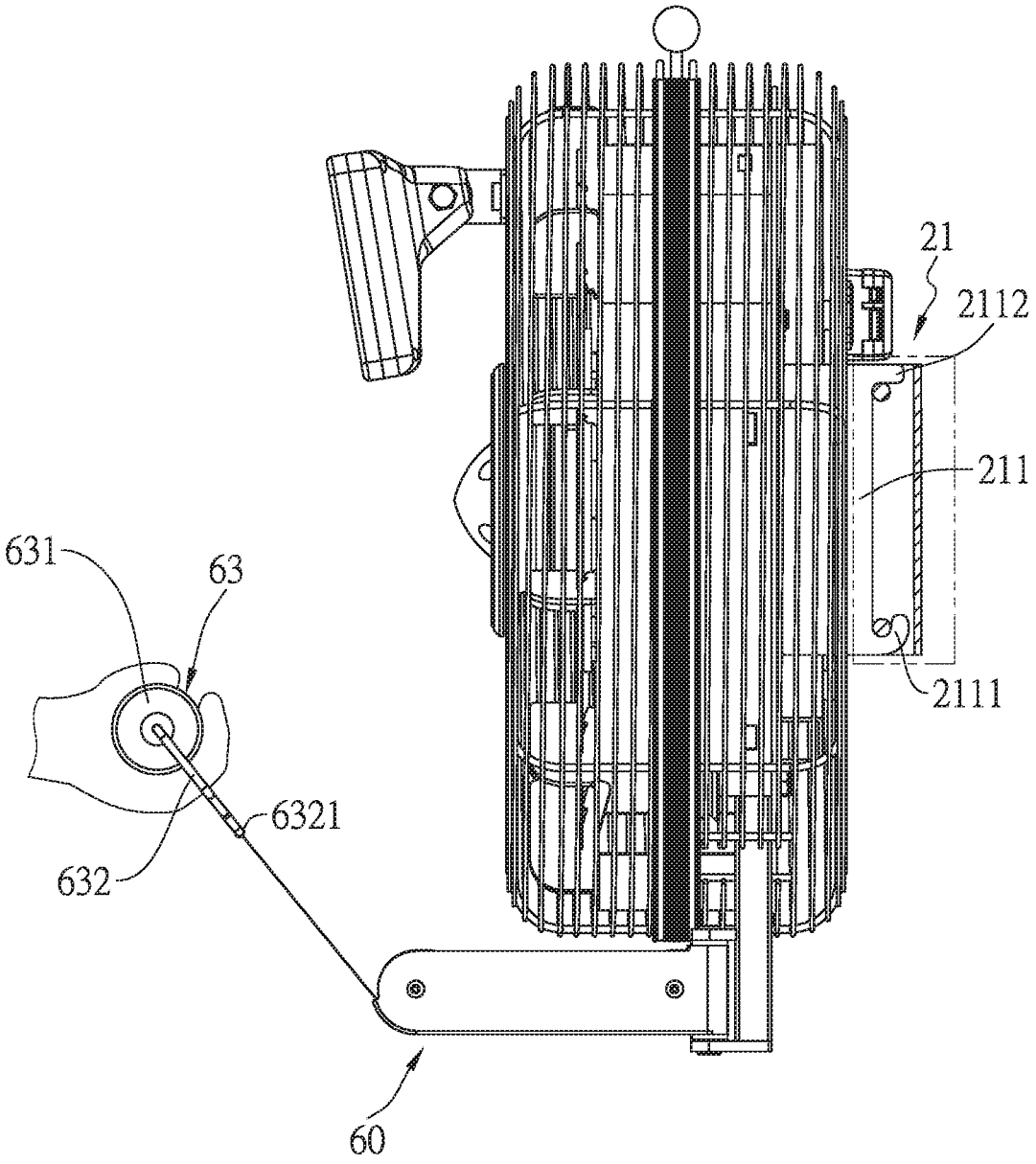
FIG. 9 is a schematic diagram of a preferred embodiment of the present invention, showing the portable exercise device hanging at a lower place.
Figure 10:
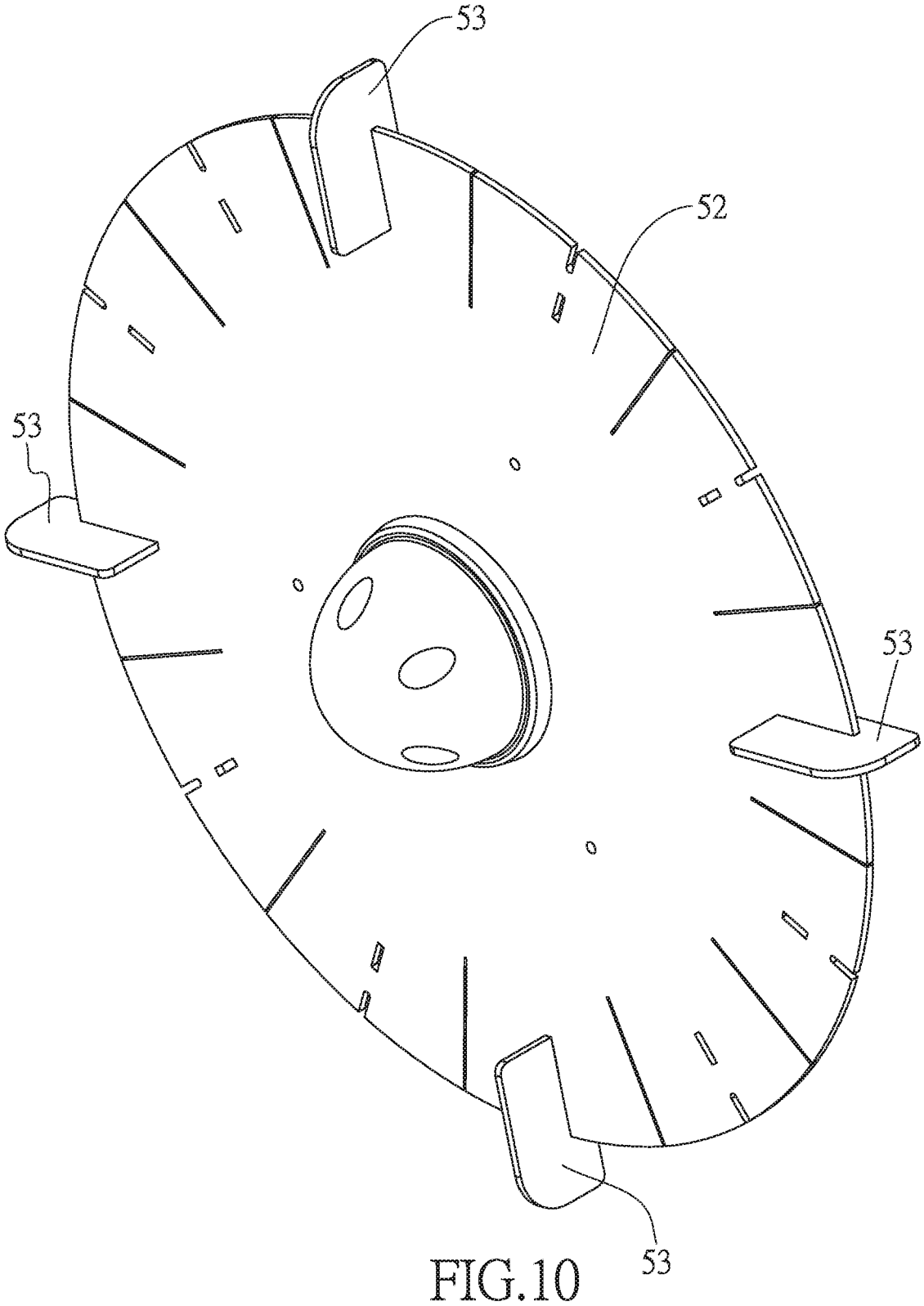
FIG. 10 is a schematic diagram of the invention showing that the fan wheel assembly is provided with different numbers of fan blades.

Referring to FIGS. 1 to 5, the present invention is a portable exercise device, which essentially comprises: a mesh frame 10, a base disc 20, two pulley assemblies 30, a support plate 40 and a fan wheel assembly 50.

The mesh frame 10 includes two mesh covers 11 and an annular fixing strip 12, and the two mesh covers 11 are fixed by the annular fixing strip 12 to define an assembling space 13. The base disc 20 is fixed to one of the mesh covers 11 and located in the assembling space 13.

The two pulley assemblies 30 are disposed on the base disc 20, and each includes: a rope wheel 31, a belt wheel 32, and a wheel shaft 33. The wheel shaft 33 is mounted on the base disc 20 via a bearing, the rope wheel 31 is disposed on the wheel shaft 33 through a one-way bearing 34, and the belt wheel 32 is fixed on the wheel shaft 33 by a hex nut 35. In this embodiment, the base disc 20 is provided with two pulley seats 60. Each of the pulley seats 60 includes: a rod 61, a rope 62, and a handle 63. The rods 61 are fixed to the base disc 20, and the ropes 62 each have one end fixed to a corresponding one of the rope wheels 31, and another end connected to a corresponding one of the handles 63. A pull rope spring box 36 is mounted on the wheel shaft 33 by a one-way bearing 34, and is provided with a spiral spring (not shown), so that when the rope 62 is pulled by the handle 63, the rope 62 can be rolled back on the rope wheel 31 by the elastic force provided by the spiral spring.

The support plate 40 has a support frame 41 provided on the base disc 20, and a mounting seat 42 provided on the support frame 41. In this embodiment, there are two support frames 41, and the support frames 41 are U-shaped and respectively mounted on the base disc 20. The mounting seat 42 is fixed on the two support frames 41, and the two pulley assemblies 30 are located between the mounting seat 42 and the base disc 20.

The fan wheel assembly 50 is disposed on the mounting seat 42 and includes: a fan wheel shaft 51 inserted through the mounting seat 42 and fixed on the base disc 20, and a fan wheel 52 fixed to the fan wheel shaft 51. In this embodiment, a generator 71 is provided on the base disc 20 and fixed on one of the support frames 41, and the generator 71 is provided with an electromagnet. The fan wheel 52 is made of aluminum. When the fan wheel 52 rotates, it can be induced with the electromagnet in the generator 71 to generate an induced current.

A belt 80 is drivingly connected to the wheel shafts 33 of the two pulley assemblies 30 and the fan wheel shaft 51 of the fan wheel assembly 50.

In this embodiment, the fan wheel assembly 50 further has a plurality of fan blades 53 fixed to the fan wheel 52, thereby increasing the weight of the fan wheel 52 and providing the user with greater resistance.

The present invention further includes a magnet adjustment assembly 90 provided on the base disc 20. The magnet adjustment assembly 90 has two magnet seat rods 91, a magnet seat 92 slidably provided on the magnet seat rods 91, and an adjusting rod 93 for controlling displacement of the magnet seat 92. The magnet seat 92 is provided with a plurality of NdFeB magnets and an inclined slot 921. The adjusting rod 93 is pivoted on the mounting seat 42 and inserted through the inclined slot 921, and the distance between the magnet seat 92 and the fan wheel 52 can be adjusted by swinging the adjusting rod 93.

Furthermore, each of the handles 63 includes a handle portion 631 and a fixing member 632. The handle portion 631 is substantially cylindrical for users to grip, and two ends of the fixing member 632 are respectively connected to the two ends of the handle portion 631 to make the handle 63 ring-shaped as a whole. The fixing member is provided with two fixing recesses 6321 which are recessed in two different directions perpendicular to each other, so that, when the user grips the handle portion 631 in different directions, the rope 62 can be fixed to one of the fixing recesses 6321 to prevent the rope 62 from sliding randomly.

The invention further includes a magnet ring 521 provided on the fan wheel 52 to provide more magnetic resistance.

Finally, the base disc 20 is provided with a wall-hanging assembly 21. The wall-hanging assembly includes two fixing pieces 211 inserted through one of the mesh covers 11, and each have a first hook 2111 and a second hook 2112. When the user hangs the portable exercise device of the present invention at a higher place, the first hook 2111 is hooked at a position farther from the ground than the second hook 2112, where the user pulls the handle portion 631, he pulls it toward the ground, and the first hook 2111 can withstand the pulling force toward the ground to prevent the portable exercise device of the invention from falling off. When the user hangs the portable exercise device of the invention at a lower place, the first hook 2111 is hooked at a position closer to the ground than the second hook 2112, where the user pulls the handle portion, he pulls it upward, and the first hook 2111 can withstand the pulling force upward to prevent the portable exercise device of the invention from falling off.

Preferably, one of the mesh covers 11 is provided with an electronic watch 72 for the user to record exercise information, such as exercise time, number of exercise times, calories consumed, and the like.

In particular, the number of the fan blades 53 on the fan wheel 52 can be adjusted according to user's needs. When the user needs a low resistance, the number of the fan blades 53 on the fan wheel 52 can be reduced so that the resistance generated by the fan wheel 52 is most suitable for the needs of the user.

By providing a support plate 40 on the base disc 20, the two pulley assemblies 30 are provided on the base disc 20, and the fan wheel assembly 50 is provided on the support plate 40, so that the fan wheel assembly 50 and the two pulley assemblies 30 are vertically arranged on top of each other, thereby reducing the overall volume. More preferably, because the volume is reduced, the user can arbitrarily move and hang the portable exercise device at the desired position, and because the portable exercise device of the invention can be hung at different positions, which allows the user to train different muscles according to the different positions.

While we have shown and described various embodiments in accordance with the present invention, it is clear to those skilled in the art that further embodiments may be made without departing from the scope of the present invention.

What is claimed is:

1. A portable exercise device comprising:

a base disc;

two pulley assemblies disposed on the base disc, and each of the two pulley assemblies including: a rope wheel, a belt wheel, and a wheel shaft, wherein the rope wheel is disposed on the wheel shaft through a one-way bearing, and the belt wheel is fixed on the wheel shaft;

a support plate has a support frame provided on the base disc, and a mounting seat provided on the support frame;

a fan wheel assembly disposed on the mounting seat and including: a fan wheel shaft inserted through the mounting seat and fixed on the base disc, and a fan wheel fixed to the fan wheel shaft;

a belt drivingly connected to the wheel shafts of the two pulley assemblies and the fan wheel shaft of the fan wheel assembly; and two pulley seats each including: a rod, a rope, and a handle, wherein the rods are fixed to the base disc, the ropes each have one end fixed to a corresponding one of the rope wheels and another end connected to a corresponding one of the handles, and two pull rope spring boxes, the two pull rope spring boxes each mounted to a corresponding one of the wheel shafts by a one-way bearing and is provided with a spiral spring.

2. The portable exercise device as claimed in claim 1 further comprising a magnet adjustment assembly provided on the base disc, the magnet adjustment assembly includes two magnet seat rods, a magnet seat slidably provided on the magnet seat rods, and an adjusting rod for controlling displacement of the magnet seat, the magnet seat is provided with a plurality of NdFeB magnets and an inclined slot, and the adjusting rod is pivoted on the mounting seat and inserted through the inclined slot.

3. The portable exercise device as claimed in claim 1, wherein each of the handles includes a handle portion and a fixing member, the handle portion is cylindrical-shaped for users to grip, two ends of the fixing member are respectively connected to the two ends of the handle portion to make the handle ring-shaped as a whole, and the fixing member is provided with two fixing recesses which are recessed in two different directions perpendicular to each other.

4. The portable exercise device as claimed in claim 1, wherein there are two said support frames, the support frames are U-shaped and respectively mounted on the base disc, the mounting seat is fixed on the two support frames, and the two pulley assemblies are located between the mounting seat and the base disc.

5. The portable exercise device as claimed in claim 1 further comprising a mesh frame which includes two mesh covers and an annular fixing strip, and the two mesh covers are fixed by the annular fixing strip to define an assembling space, and the base disc is fixed to one of the mesh covers and located in the assembling space.

6. The portable exercise device as claimed in claim 1 further comprising a generator provided on the base disc and fixed on one of the support frames, the generator is provided with an electromagnet, the fan wheel is made of aluminum, and the generator is induced with the fan wheel to generate induced current.

7. The portable exercise device as claimed in claim 1, wherein the fan wheel assembly further has a plurality of fan blades fixed to the fan wheel.

8. The portable exercise device as claimed in claim 2, wherein the fan wheel assembly further has a plurality of fan blades fixed to the fan wheel.

9. The portable exercise device as claimed in claim 3, wherein the fan wheel assembly further has a plurality of fan blades fixed to the fan wheel.

10. The portable exercise device as claimed in claim 4, wherein the fan wheel assembly further has a plurality of fan blades fixed to the fan wheel.

11. The portable exercise device as claimed in claim 5, wherein the fan wheel assembly further has a plurality of fan blades fixed to the fan wheel.

12. The portable exercise device as claimed in claim 6, wherein the fan wheel assembly further has a plurality of fan blades fixed to the fan wheel.

13. The portable exercise device as claimed in claim 1 further comprising a magnet ring provided on the fan wheel.

14. The portable exercise device as claimed in claim 2 further comprising a magnet ring provided on the fan wheel.

15. The portable exercise device as claimed in claim 3 further comprising a magnet ring provided on the fan wheel.

16. The portable exercise device as claimed in claim 4 further comprising a magnet ring provided on the fan wheel.

17. The portable exercise device as claimed in claim 5 further comprising a magnet ring provided on the fan wheel.

18. The portable exercise device as claimed in claim 6 further comprising a magnet ring provided on the fan wheel.

19. The portable exercise device as claimed in claim 5, wherein the base disc is provided with a wall-hanging assembly, and the wall-hanging assembly includes two fixing pieces inserted through one of the mesh covers, and each have a first hook and a second hook.

* * * * *